United States Patent [19]

Belbin, Sr.

[11] Patent Number: 4,512,500

[45] Date of Patent: Apr. 23, 1985

[54] TABLET STORAGE AND DISPENSING DEVICE

[76] Inventor: Chesley E. Belbin, Sr., P.O. Box 490, Bay Roberts, Newfoundland, Canada, A0A 1G0

[21] Appl. No.: 448,251

[22] Filed: Dec. 9, 1982

[51] Int. Cl.[3] ..... B65D 83/04

[52] U.S. Cl. ..... 221/82; 206/538

[58] Field of Search ..... 221/2, 7, 8, 82, 89, 221/4, 5, 86, 186; 206/534.2, 538, 533, 534

[56] References Cited

U.S. PATENT DOCUMENTS

| | | | |
|---|---|---|---|
| 1,680,130 | 8/1928 | Conner | 221/82 X |
| 2,258,866 | 10/1941 | Sanford . | |
| 2,633,273 | 3/1953 | Benjamin et al. . | |
| 3,016,167 | 1/1962 | Richards, Jr. et al. . | |
| 3,077,261 | 2/1963 | Tapper . | |
| 3,189,221 | 6/1965 | Lachance . | |
| 3,204,834 | 9/1965 | Gadenne . | |
| 3,318,491 | 5/1967 | Williamson . | |
| 3,332,575 | 7/1967 | Pilot et al. | 221/82 X |

*Primary Examiner*—Stanley H. Tollberg

*Attorney, Agent, or Firm*—LeBlanc, Nolan, Shur & Nies

[57] ABSTRACT

A tablet storage and dispensing device having a tablet dispensing wheel which is formed along its periphery with outwardly opening tablet-receiving recesses or pockets and which is rotatable by a manually manipulatable control wheel to positions for dispensing the tablets one at a time through an opening in a casing. Both the dispensing wheel and the control wheel are rotatably mounted in a common chamber which is formed in the casing. A separate chamber may be provided for storing a reserve supply of tablets.

12 Claims, 6 Drawing Figures

TABLET STORAGE AND DISPENSING DEVICE

FIELD OF INVENTION

This invention relates to article dispensing devices and is particularly concerned with a novel, pocket-sized device for storing and dispensing tablets.

SUMMARY AND OBJECTS OF INVENTION

The general aim and purpose of this invention is to provide a novel, pocket-sized tablet storage and dispensing device which is small, compact, economical to manufacture, easy to operate, rugged, reliable in operation and easy to clean.

The present invention is directed to the type of tablet storage and dispensing device having a tablet dispensing wheel which is formed with tablet-receiving recesses or pockets and which is rotatable by a manually manipulatable control wheel to positions for dispensing the tablets one at a time through an opening in a carrying case.

In accordance with this invention, both the control wheel and the dispensing wheel are received in a common chamber in the carrying case. This feature of the invention significantly simplifies the construction required for rotatably mounting the two wheels. It also permits the control and dispensing wheels to be integrally joined together for manufacture as a single part.

In carrying out the invention, the casing's wheel-receiving chamber is formed as a diametrically stepped bore. The tablet-dispensing wheel is received in a reduced diametered section of the stepped bore, while the control wheel is received in a diametrically enlarged section of the stepped bore next to the dispensing wheel. The dispensing wheel is axially confined between the control wheel and an outer side wall of the casing, and the control wheel is axially confined between the opposite side wall of the casing and an annular shoulder which is formed between the reduced and enlarged sections of the stepped bore. The casing's side walls cover the ends of the stepped bore and rotatably mount the assembly of the control and dispensing wheels.

In accordance with a further feature of this invention, a simplified spring biased detent mechanism is mounted in the casing's main body or housing portion between the side walls and coacts with circumferentially spaced apart outwardly opening notches or recesses on the periphery of the control wheel to provide for the stepped rotation of the wheel assembly to positions for dispensing the tablets one at a time through an opening or passage in the casing.

In accordance with a further feature of this invention, the casing is formed with a separate chamber for holding a reserve supply of tablets. This construction avoids a problem which arises in constructions where the reserve supply of tablets and the dispensing wheel are received in a common chamber. With such a construction, the reserve supply may jam and consequently fail to enter the tablet-receiving recesses or pockets on the dispensing wheel.

Further objects of this invention will appear as the description proceeds in connection with the below-described drawings and the appended claims.

DETAILED DESCRIPTION

Figure 1:
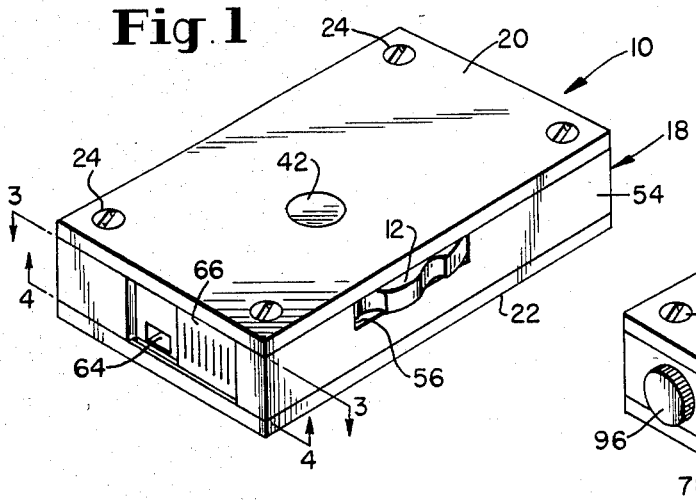
FIG. 1 is a perspective view of the tablet storage and dispensing device incorporating the principles of this invention.
Figure 2:
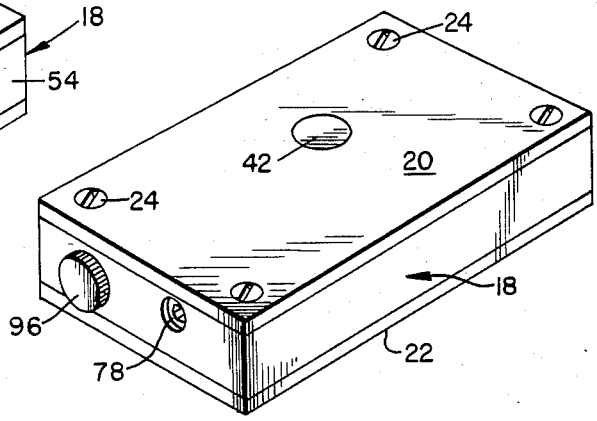
FIG. 2 is another perspective view of the tablet storage and dispensing device turned 180° from the position shown in FIG. 1.

Referring to FIGS. 1–5, the illustrated embodiment of the pocket-sized tablet dispensing device mainly comprises a casing or housing structure 10, a manually manipulatable control wheel 12, a tablet-dispensing wheel 14 (see FIGS. 4 and 5) and a detent mechanism 16.

In the illustrated embodiment, casing 10 comprises a rectangularly shaped, flat-sided main housing part 18 and a pair of rectangular, flat-sided cover members 20 and 22. Cover members 20 and 22 may be regarded as the casing's opposing side walls or the casing's top and bottom walls depending on how the dispensing device is viewed.

Cover member 20 interfittingly seats against and is detachably fixed to one flat side surface 21 of housing 18 by screws 24. Cover member 22 interfittingly seats against and is detachably fixed to the oppositely facing flat side surface 23 of housing 18 by screws 26 (see FIG. 4). The component parts of casing 10 are rigid and may be molded from any suitable plastic material. The plastic material may be sufficiently clear to permit the user to view wheels 12 and 14 which are rotatably mounted in casing 10. Cover member 22 and housing 18 may be integrally formed as one piece, if desired.

Figure 3:
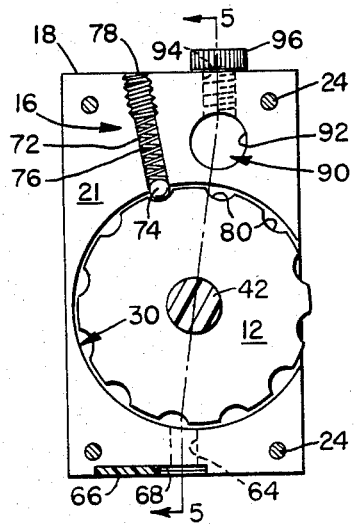
FIG. 3 is a section taken substantially along lines 3—3 of FIG. 1.
Figure 4:
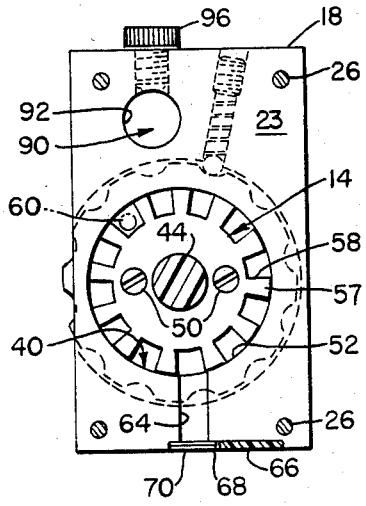
FIG. 4 is a section taken substantially along lines 4—4 of FIG. 3.
Figure 5:
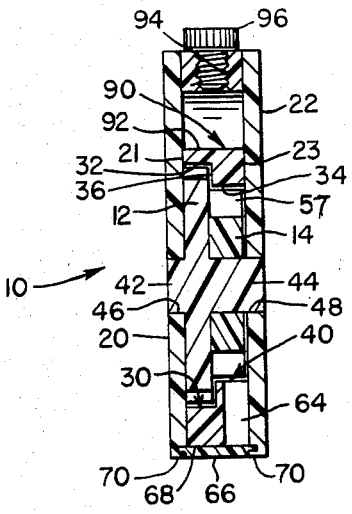
FIG. 5 is a section taken substantially along lines 5—5 of FIG. 3.

As shown in FIGS. 3–5, a diametrically stepped, cylindrically smooth bore 30 is formed through housing 18 and has a diametrically enlarged section 32 and a diametrically reduced section 34. An annular, radially extending flat shoulder 36 is formed at the juncture between bore sections 32 and 34 as best shown in FIG. 5.

Still referring to FIG. 5, bore section 32 opens at the housing's side surface 21 while bore section 34 opens at the oppositely facing housing surface 23. The open end of bore section 32 is covered by cover member 20, and the open end of bore section 34 is covered by cover member 22. The uniformly diametered internal wall surfaces of bore sections 32 and 34 and the opposing, spaced apart cover members 20 and 22 cooperate to define and delimit a wheel-receiving chamber 40.

Still referring to FIGS. 3–5, dispensing wheel 14 is coaxially and rotatably received in bore section 34, and control wheel 12 is coaxially and rotatably received in bore section 32 immediately adjacent to dispensing wheel 14. Wheel 12 is formed with a pair of axially aligned stub shafts 42 and 44 extending in opposite directions from the oppositely facing sides of the wheel. Shaft 42 is interfittingly received and journaled in a uniformly diametered, cylindrically smooth aperture 46 which is formed through cover member 20. Shaft 44 is interfittingly and coaxially journaled in another cylindrically smooth, uniformly diametered aperture 48 which is formed through cover member 22. Apertures 46 and 48 are axially aligned as shown in FIG. 5. The flat end of shaft 42 lies flush with the exterior flat surface of cover member 20, and the flat end of shaft 44 likewise lies flush with the exterior flat surface of cover member 22.

Figure 6:
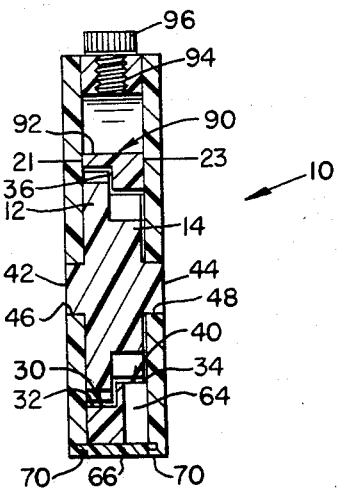
FIG. 6 is a fragmentary section showing a modification in which the dispensing and control wheels are integrally formed as one piece.

In the illustrated embodiment, dispensing wheel 14 is formed separately of control wheel 12 and is coaxially mounted on shaft 44 between wheel 12 and cover member 22. Dispensing wheel 14 is nonrotatably fixed to control wheel 12 by one or more screws 50 (see FIG. 4) or other suitable means. Manual rotation of control wheel 12 therefore imparts rotation to dispensing wheel 14. It will be appreciated that, if desired, wheels 12 and 14 may be integrally joined together by molding or otherwise forming them as one piece as shown in FIG. 6.

In the illustrated embodiment, dispensing wheel 14 is axially confined between cover member 22 and control wheel 12, and control wheel 12 is axially confined between shoulder 36 and cover member 20.

As shown in FIG. 4, bore section 34 lies entirely within the confines or outer boundaries of housing 18. The formation of bore section 34 thus defines a uniformly diametered, cylindrically smooth internal annular wall surface 52 completely encircling or peripherally surrounding dispensing wheel 14. Dispensing wheel 14 thus lies entirely within the chamber portion which is delimited by wall 52 and is completely enclosed within casing 10 as shown.

As shown in FIGS. 1 and 3, the outer diameter of bore section 32 extends beyond the extremities of housing 18 so that when bore section 34 is formed, it cuts away a region of the housing's side edge surface 54. The cut away portion of the housing's side edge 54 and cover 20 cooperate to form an elongated, rectangular slot or aperture 56 opening into bore section 32. Control wheel 12 has a diameter which is substantially larger than that of dispensing wheel 14 so that control wheel 12 extends through aperture 56 in the manner shown in FIG. 1. The major portion of control wheel 12 therefore lies in chamber 40. The smaller exposed portion of control wheel 12 lying exteriorly of casing 10 is engageable by the user's index finger or thumb for manually rotating the assembly of wheels 12 and 14.

As best shown in FIG. 4, dispensing wheel 14 is formed along its outer periphery with a multiplicity of equiangularly spaced apart, radially extending teeth or projections 57. Teeth 57 define a corresponding number of equiangularly, circumferentially spaced apart, radially outwardly opening tablet-receiving recesses or pockets 58. Each of the pockets 58 is preferably sized to receive and store a single tablet which is indicated in phantom line at 60 in FIG. 4. The clearance space between the outer ends of teeth 57 and wall 52 is just large enough to permit free rotation of dispensing wheel 14 and is small enough to prevent tablets 60 from being dislodged into the circumferential space lying between teeth 57 and wall 52. In this manner, tablets 60 are confined in place in recesses 58 until the recesses are rotated successively to positions where they align with a tablet discharge passage 64 (see FIGS. 1 and 3–5).

Passage 64 is formed through a portion of housing 18 and extends generally radially of bore section 34. At one end, passage 64 opens into bore section 34 through wall 52. At the other end, passage 64 opens to the exterior of casing 10. Except for passage 64 and aperture 56, chamber 40 is completely enclosed.

Casing 10 may be equipped with a suitable cover 66 for covering the open outer end of the tablet-dispensing passage 64 as shown in FIGS. 1 and 3–5. In the illustrated embodiment, cover 66 is retained in and manually slidable along channels which are formed between a recessed edge surface 68 of housing 18 and cover retaining lips 70 as best shown in FIG. 5. Lips 70 are integral with cover members 20 and 22 as shown.

Referring to FIG. 3, detent mechanism 16 is mounted in a bore 72 of housing 18 and comprises a detent ball 74 and a coiled spring 76 which is compressed between ball 74 and a set screw 78. Screw 78 is threaded into the outer end of bore 72 which opens radially into the enlarged bore section 32.

Control wheel 12 is formed along its outer periphery with a large plurality of equiangularly, circumferentially spaced apart radially outwardly opening recesses or pockets 80 for receiving detent ball 74. Recesses 80 correspond in number to and have the same angular spacing as the tablet-receiving recesses 58 in dispensing wheel 14.

Spring 76 biases ball 74 radially inwardly to a position where it partially protrudes beyond bore 72 to seat in an aligning one of the control wheel's recesses 80. In this manner, the spring biased ball 74 operates to releasably latch the assembly of wheels 12 and 14 in equiangularly spaced apart positions where each of the tablet-recesses 58 successively registers with discharge passage 64. Ball 74 may be radially forced out of each recess 80 against the bias of spring 76 by applying a sufficient rotational force to control wheel 12. The ends of each recess 80 may be sloped to reduce the force required for forcing the ball out of each recess. Accordingly, detent mechanism provides for the stepped rotation of the assembly of wheels 12 and 14 to positions where the tablet-receiving recesses 58 successively register with discharge passage 64 for dispensing tablets 60 one at a time by gravity through passage 64. Dispensing wheel 14 is loaded with tablets by positioning each of the vacant recesses 58 in alignment with passage 64 and by dropping a tablet through passage 64 for reception in the tablet-receiving recess.

As shown in FIGS. 3–5, the tablet storage and dispensing device of this invention is advantageously equipped with an additional tablet-storage chamber 90 for storing a reserve supply of tablets. Chamber 90 is spaced from and does not communicate with chamber 40 and is defined by a cylindrically smooth bore 92 which is formed through housing 18 along an axis lying parallel to bore 30. The open ends of bore 92 are closed by cover members 20 and 22 so that chamber 90 is delimited by the smooth cylindrical wall of bore 92 and cover members 20 and 22. Housing 18 is additionally formed with an internally threaded access opening 94 which opens into and normally intersects bore 92. A plug 96 is removably threaded into access opening 94 as shown.

Upon removing plug 96, chamber 90 may be filled with a reserve supply of tablets. In order to remove the tablets from chamber 90, plug 96 is first removed and the dispensing device is then tilted in a direction to allow the tablets to drop out through opening 94 by gravity.

From the foregoing description it will be appreciated that the tablet storage and dispensing device of this invention has relatively few movable, working parts which are of rugged construction and which operate reliably to dispense tablets one at a time through opening 64. Furthermore, the tablet dispensing and storage device of this invention is very economical to manufacture and is compactly sized so that it can be carried in a person's pocket or in a pocketbook. Additionally, the tablet dispensing and storage device of this invention is easily cleaned by removing cover 20 and the assembly of wheels 12 and 14. Finally, it will be appreciated that the tablets are stored in the device's enclosed chambers 40, 90 where they are protected from the environment and contamination.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A pocket-sized tablet storage and dispensing device comprising a casing having a chamber defined by first and second, spaced apart wall portions and first and second apertures opening into said chamber and also opening exteriorly of said casing, a manually manipulated control wheel in the interior of said casing between said spaced apart wall portions, said control wheel having shaft means rotatably supporting said wheel from both of said spaced apart wall portions and having a portion received in said chamber, said control wheel also extending through said first aperture from said chamber to the exterior of said casing such that a peripheral portion thereof lies exteriorly of said casing to enable said control wheel to be manually rotated by the user, a tablet dispensing wheel disposed entirely within said chamber and formed along its outer periphery with a plurality of circumferentially spaced, radially outwardly opening, tablet-receiving recesses each sized to receive and store a single tablet, said dispensing wheel being axially aligned with said control wheel, and said dispensing wheel being rigid with and rotatable with said control wheel, said casing being formed with an internal wall further delimiting said chamber and peripherally surrounding said dispensing wheel, the clearance between said wall and the outer periphery of said dispensing wheel being large enough to permit rotation of said dispensing wheel but small enough to prevent tablets stored in said recesses entering the space between said wall and the outer periphery of said dispensing wheel, said second aperture being formed through said wall, and said dispensing wheel being rotatable with said control wheel to positions where said recesses successively register with said second aperture to provide for the gravity discharge of the stored tablets one at a time through said second aperture.

2. The pocket-sized tablet storage and dispensing device defined in claim 1 wherein said chamber is still further defined by a diametrically stepped bore having its opposite ends closed by said wall portions, said dispensing wheel being received in a reduced diametered section of said bore, and said control wheel being received in an enlarged diametered section of said bore, said enlarged section having a greater diameter than said reduced section, said control wheel having a diameter which is larger than the diameter of said dispensing wheel.

3. The pocket-sized tablet storage and dispensing device defined in claim 2, including shaft means rigid with at least one of said wheels and rotatably received in axially aligned spaced apart apertures formed in said first and second wall portions, such that said first and second wall portions rotatably support the assembly of said control and dispensing wheels.

4. The pocket-sized tablet storage and dispensing device defined in claim 3 wherein the one of said will portions closing the enlarged diametered end of said bore is formed separately of said casing and is detachable fixed to said casing to enable said one of said wall portions to be removed for accessing said chamber and for removing the assembly of said dispensing and control wheels from said chamber.

5. The pocket-sized tablet storage and dispensing device defined in claim 3 wherein said stepped bore is formed with an annular shoulder at a juncture between said enlarged and reduced diameter sections, wherein said control wheel is axially confined between said shoulder and one of said wall portions, and wherein said dispensing wheel is axially confined between said control wheel and the other of said wall portions.

6. The pocket-sized tablet storage and dispensing device defined in claim 1 wherein said dispensing wheel is integrally joined to said control wheel.

7. The pocket-sized tablet storage and dispensing device defined in claim 1 wherein said casing is formed with an additional chamber which is spaced from and out of communication with the wheel-receiving chamber for storing a reserve supply of tablets.

8. The pocket-sized tablet storage and dispensing device defined in claim 1 wherein said wheel-receiving chamber is defined by a bore formed through said casing and having its opposite ends closed by said first and second wall portions, said dispensing wheel and a portion of said control wheel being rotatably received in said bore, said device also including shaft means rigid with at least one of said wheels and rotatably received in axially aligned spaced apart apertures which are formed one in each of said first and second wall portions, such that said first and second wall portions rotatably support the assembly of said control and dispensing wheels.

9. The pocket-sized tablet storage and dispensing device defined in claim 8 wherein at least one of said wall portions is formed separately of said housing portion and is detachably fixed to said housing portion to enable said at least one of said wall portions to be removed for accessing said chamber and for removing the assembly of said dispensing and control wheels from said chamber.

10. The pocket-sized tablet storage and dispensing device defined in claim 9 wherein said first aperture is delimited in part by said housing portion and in part by the detachable one of said wall portions.

11. The pocket-sized tablet storage and dispensing device defined in claim 9 wherein a further bore is formed through said housing portion and has its opposite ends covered by said first and second wall portions to define an additional chamber for storing a reserve supply of tablets, said additional chamber being spaced from and out of communication with said wheel-receiving chamber.

12. The pocket-sized tablet storage and dispensing device defined in claim 8 comprising a detent mechanism mounted in said housing portion and coacting with circumferentially spaced apart recesses on the periphery of said control wheel to provide for the stepped rotation of the assembly of said control and dispensing wheels to positions where the tablet-receiving recesses successively register with said second aperture.

* * * * *